United States Patent [19]

Voorthuyzen

[11] 4,282,792

[45] Aug. 11, 1981

[54] COUNTER PRESSURE SYSTEM FOR STRINGED INSTRUMENTS

[76] Inventor: Peter Voorthuyzen, 113 Ball Ave., Canastota, N.Y. 13032

[21] Appl. No.: 59,735

[22] Filed: Jul. 23, 1979

[51] Int. Cl.[3] ..... G10D 3/00; G10D 1/02; G10D 3/04; G10D 3/12

[52] U.S. Cl. ..... 84/295; 84/277; 84/297 R; 84/302; 84/309; 84/312 R

[58] Field of Search ..... 84/295, 297 R, 297 S, 84/309, 277, 302, 31 RR

[56] References Cited

U.S. PATENT DOCUMENTS

| | | | |
|---|---|---|---|
| 465,490 | 12/1891 | Olson | 84/297 R |
| 3,603,193 | 9/1971 | Archibald | 84/309 |

FOREIGN PATENT DOCUMENTS

| | | | |
|---|---|---|---|
| 1080094 | 12/1954 | France | 84/297 |
| 529425 | of 1955 | Italy | 84/309 |

*Primary Examiner*—L. T. Hix
*Assistant Examiner*—Thomas H. Tarcza
*Attorney, Agent, or Firm*—Bruns & Jenney

[57] ABSTRACT

A counter pressure system for use in a stringed instrument of the type played with a bow for improving the tone of the instrument in both volume and in quality. The system includes the main or melody producing strings and one or more counter pressure strings that are arranged to accept at least part of the pressure from the main strings and transfer it away from the main bridge. The relieved pressure is redistributed by the counter pressure system in a manner that extends the quality of sound produced by the instrument. In practice, part of the total string pressure is translated to the sound box via the main bridge while the remaining pressure is imparted to the box via an auxiliary bridge located forward of the main bridge. A sounding post is located under one foot of each bridge which, in the case of a violin, would be the foot on the E string side of the instrument.

26 Claims, 11 Drawing Figures

COUNTER PRESSURE SYSTEM FOR STRINGED INSTRUMENTS

BACKGROUND OF THE INVENTION

This invention relates to a stringed instrument of the type played with a bow and, in particular, to a counter pressure system for use in a stringed instrument that extends the volume and the quality of the tone produced.

The exact features that contribute to the quality of sound produced by a stringed instrument are difficult to define. However, it is known that by bringing more wood to vibration the volume and quality of the tones produced can be improved. Ordinarily, as a good violin ages and is played, the vibrations of the melody strings will result in loosening of the wood and thus produce an improvement in tonal response. However, beyond usage, little has heretofore been done to either extend or accelerate the tonal improvement of such instruments.

Typically, when a stringed instrument, such as a violin, is properly tuned, a good deal of pressure is transferred through the main bridge to the belly of the sound box. Heretofore, the bridge, in order to withstand the subject pressure, was formed of a relatively hard wood. As a consequence, wood of the instrument, particularly under the foot on the E string side of the instrument, would become worn with usage and little could be done to correct this situation within the framework of the basic instrument design.

Similarly, it is also extremely important when playing a conventional instrument to avoid bowing too close to the bridge in order to prevent whistling and to maintain the strength of the tones produced by the instrument. Again, because of the basic design of the instrument, little if any margin of error is provided for concerning the bowing technique of the artist. This, in effect, forces the artist to devote part of his concentration towards the mechanical aspects of playing rather than the artistic value of the music produced.

SUMMARY OF THE INVENTION

It is therefore an object of the present invention to improve stringed instruments of the type ordinarily played with a bow.

Another object of the present invention is to extend the volume and tonal qualities of existing stringed instruments by bringing more wood to vibration.

A further object of the present invention is to accelerate the loosening process experienced by new stringed instruments.

A still further object of the present invention is to help prevent the wood of a stringed instrument from becoming worn with usage.

Yet another object of the present invention is to provide a counter pressure system for use in a stringed instrument for relieving some of the pressure normally applied by the melody strings to the main bridge of the instrument.

Yet a still further object of the present invention is to redistribute the pressure of the melody strings of an instrument so that it can be carried into the sound box by means of two individual sound posts.

These and other objects of the present invention are attained by means of a counter pressure system for use in a stringed instrument that includes one or more counter pressure strings extending in a plurality of runs beneath the main or melody strings between the tail piece and the finger board of the instrument. Each run is caused to pass over an auxiliary bridge located forward of the main bridge, through an opening provided in the main bridge and under a counter pressure bridge that is suspended between the melody strings and the counter pressure runs whereby a portion of the melody string pressure is transferred through the system to the auxiliary bridge. A sound post is positioned with the sound box of the instrument beneath both the main bridge and the auxiliary bridge.

BRIEF DESCRIPTION OF THE DRAWINGS

For a better understanding of these and other objects of the present invention reference is had to the following detailed description of the invention that is to be read in conjunction with the accompanying drawings, wherein.

DESCRIPTION OF THE INVENTION

Figures 1, 4, 5, 6, 7, 8:
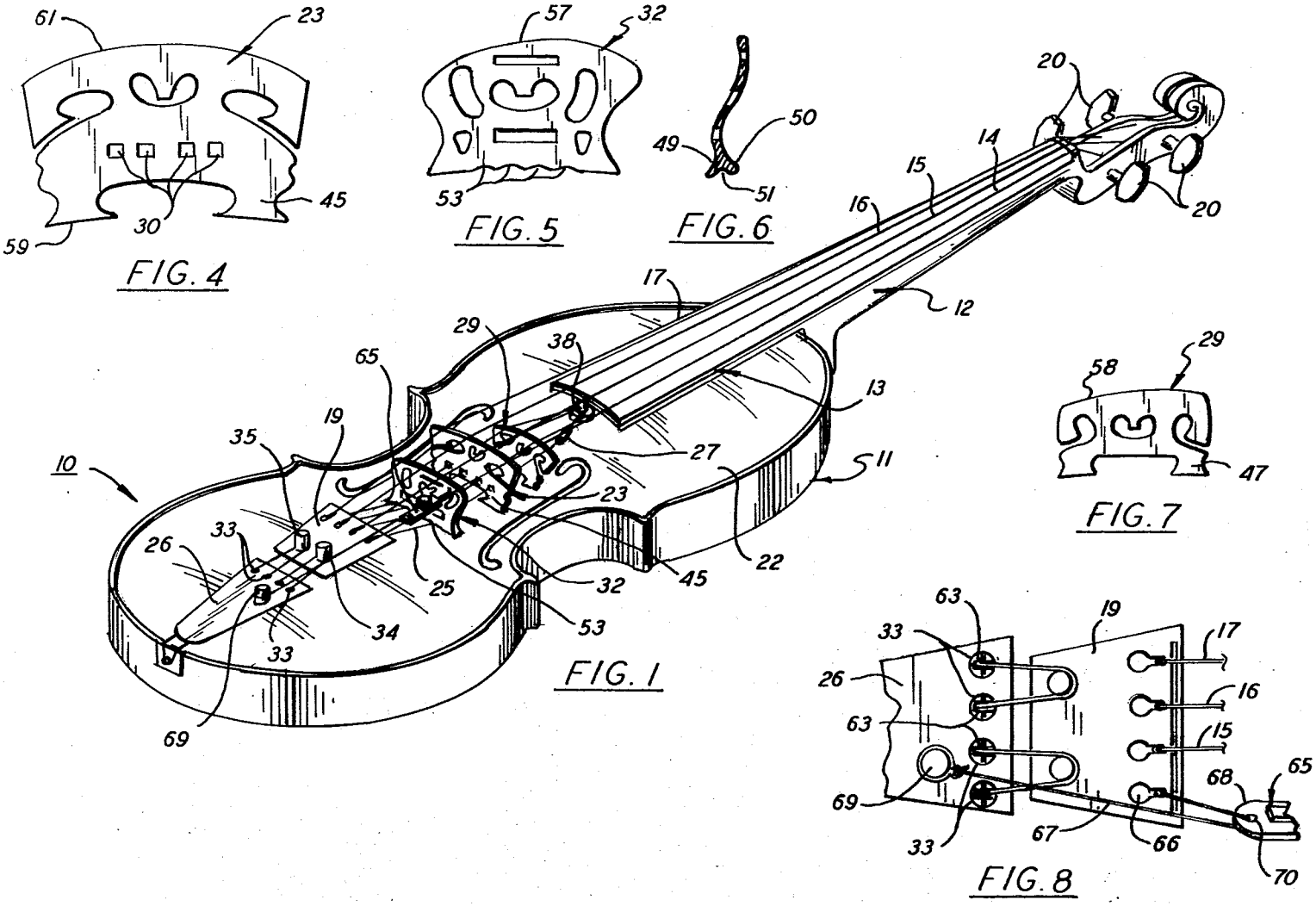
FIG. 1 is a perspective view of a violin embodying the teachings of the present invention.
FIG. 4 is an enlarged front view of the main bridge used in the instant instrument.
FIG. 5 is an enlarged front view of the counter pressure bridge used in the present instrument.
FIG. 6 is an end view in section of the counter pressure bridge showing the compound foot arrangement thereof.
FIG. 7 is also an enlarged front view of the auxiliary bridge used in the present instrument.
FIG. 8 is a partial top plan view of the tail piece section of the instrument.

The present invention will herein be described with reference to a violin generally referenced 10, as illustrated in FIG. 1. It should be noted, however, that the invention has broader application and can be utilized in association with a wide variety of stringed instruments played by a bow. The violin depicted is of conventional design and includes a body or sound box 11, a neck 12 and a finger board 13 all of which are of typical construction. Four main melody strings 14–17 are secured at one end in a floating tailpiece 19, the function of which will be explained in greater detail below, while the other end of the strings are wound about tuning pegs 20—20 in a conventional manner. In assembly, the main strings are supported above the top surface or belly 22 of the sound box by means of a main bridge 23.

Figure 11:
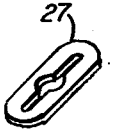
FIG. 11 is an enlarged perspective view of a string connector used to join the ends of the counter pressure strings in assembly.

A counter pressure system is herein provided for transferring some of the main string pressure away from the main bridge. To this end, a counter pressure string 25 is passed back and forth beneath the main melody strings between the back of the finger board and the main tailpiece 26 of the instrument to create a suspension network for helping to support the melody strings in the assembly. In practice, the string is tied at one end to an ebony connector 27 of the type illustrated in FIG. 11. The connector contains a central hole and two slits extending longitudinally in opposite directions from the hole. A knot in the end of the counter pressure string makes it secure in one of the slits much in the same manner used to secure a string in a conventional tailpiece.

Figure 2:
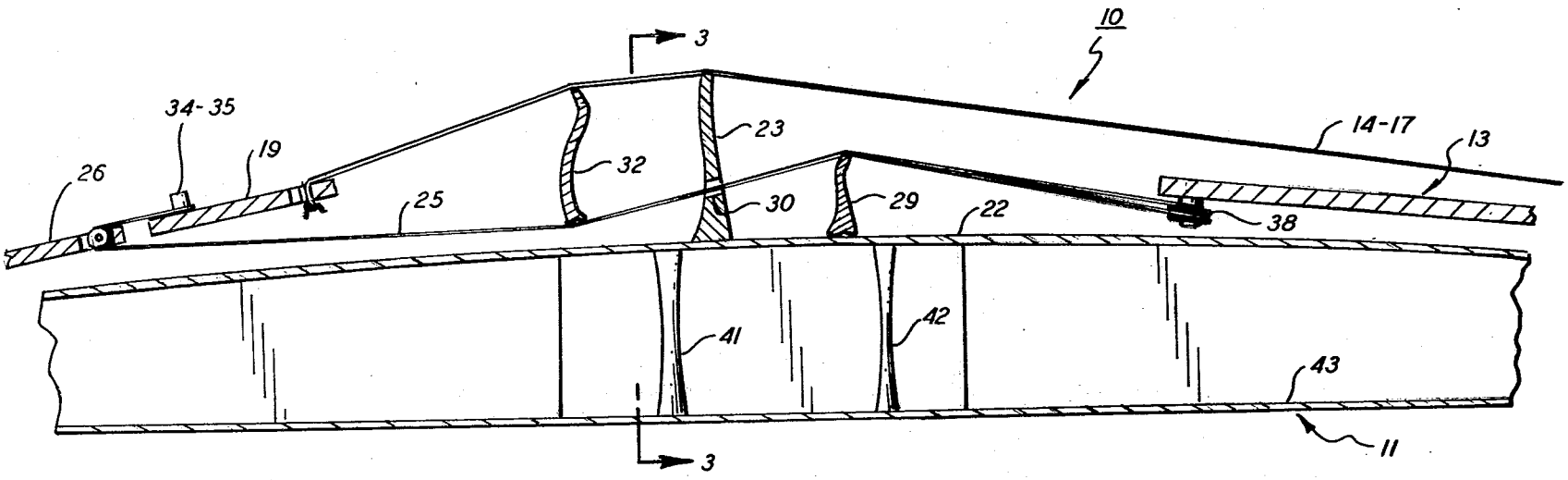
FIG. 2 is an enlarged partial side elevation of the instrument shown in FIG. 1 that is illustrated in section to show the position of the sound posts located within the sound box thereof.
Figure 9:
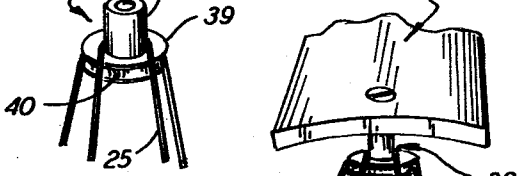
FIG. 9 is an enlarged perspective view of the support post for mounting the counter pressure string upon the finger board.
Figure 10:
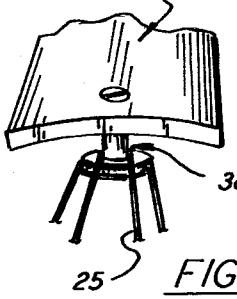
FIG. 10 is a perspective view of the support post secured at the rear margin of the finger board.

The connector is located beneath the E string close to the finger board as shown in FIG. 1. A gut cello A string has been found to be a suitable material for use in constructing counter pressure runs. The first of the four runs is initiated from the connector by passing the string over an auxiliary bridge 29 located forward of the main bridge. The string is then passed through one of four spaced-apart openings 30—30 (FIG. 4) formed in the main bridge and then under a counter pressure bridge 32 that is suspended between the melody strings and the counter pressure runs behind the main bridge as shown in FIG. 2.

After passing under the counter pressure bridge, the counter pressure string is passed upwardly through one of the receiving holes 33—33 formed in the main tailpiece 26 and looped about the first of two raised pins 34–35 secured in the back of the adjacent floating tailpiece. The string is passed out of the main tailpiece via the next adjacent hole 33, passed under the counter pressure bridge back through the main bridge, and over the auxiliary bridge to provide a second run similar to the first. At the end of the second run, however, the string is turned about the smaller diameter body section of support post 38 which is affixed to the back of the finger board.

Once turned about the support post, the counter pressure string is again brought out of the tail piece as described above, turned about pin 35, and passed back to the post thereby completing four runs of string below the main or melody strings. The last run in the series is turned about the large disc 39 at the distal end of the post and is secured in the connector using the opposite slit thereby completing the circuit. The disc of the post is provided with a notch 40 for preventing the string from slipping out of position in assembly.

In practice, the auxiliary bridge and the counter pressure bridge are both located about an equal distance from the main bridge and are positioned in parallel alignment therewith. The height of the auxiliary bridge and the counter pressure bridge are related so that the strings of each counter pressure run from about the same angle with the belly 22 of the instrument as the runs approach and leave the auxiliary bridge. In the case of a standard size violin, this angle will be approximately 30°.

As is best illustrated in FIG. 2, the runs formed by the counter pressure strings, acting in conjunction with the bridges 29 and 32, form a suspension network beneath the main strings of the instrument that is capable of accepting a portion of the total pressure exerted by the main strings on the main bridge. The pressure accepted by the counter pressure system is diverted to the auxiliary bridge so that the sound producing vibrations now have two distinct paths by which they may reach the sound box. As a result of this construction, a relatively larger amount of wood in the instrument is set into motion by the string initiated vibrations thereby extending the response of the instrument.

Figure 3:
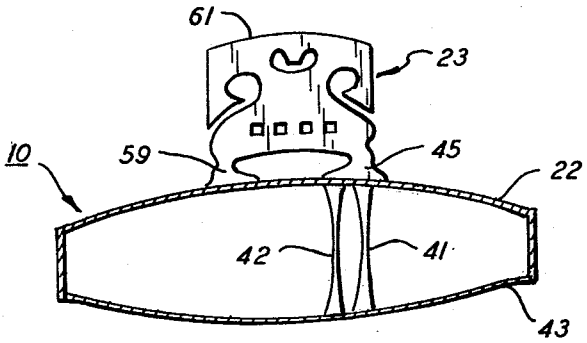
FIG. 3 is a section taken along lines 3—3 in FIG. 2.

To further extend the response of the instrument, two separate sound posts are herein utilized to carry the vibratory impulses into the sound box. These include the primary sound post 41, which is located under the main bridge, and a secondary sound post 42, which is located under the auxiliary bridge. The posts are mounted in the box in a conventional manner between the belly 22 and the back 43 thereof. The primary post is located close to the foot 45 of the main bridge positioned on the E string or "first string" side thereof. The secondary post is similarly located beneath the foot 47 of the auxiliary bridge 29. Preferably, as seen in FIG. 3, the primary post is positioned inside of the secondary post or closer to the center of the instrument. The primary post is further moved just to the back side of the main bridge while the secondary post is moved a little forward of the auxiliary bridge (FIG. 2). Because the pressure load is distributed between the two posts, they can be constructed of soft wood thereby increasing the overall vibratory response of the system. In light of the fact that the auxiliary bridge carries less pressure than the main bridge, the secondary post is made thinner than the primary post. Each sound post is generally concave in shape having a thinner diameter at the center than at the ends.

Turning now more specifically to FIGS. 2, 5 and 6, the counter pressure bridge 32 is generally S-shaped, as is the auxiliary bridge, in order to stabilize their positions in assembly. The counter pressure bridge is provided with a widened bifurcated base containing two feet 49, 50 (FIG. 6) that are separated by a lateral groove 51 extending across the length of the element. The divided bottom along with the S-like configuration enable the counter pressure bridge to be securely seated between the main strings and the counter pressure runs. String notches 53 can also be formed in the base of the bridge to maintain the spacing between runs and further enhance the seating capability of the suspended bridges.

The top surfaces of both the counter pressure bridge and the auxiliary bridge, noted as 57 and 58 respectively, slope downwardly from the first string toward the last string which, for a violin, would be from the E string side toward the G string side. The gradual sloping of the two bridges causes a predominance of the pressure transferred to the counter pressure system to be carried chiefly by the first two runs on the E string side of the instrument. Sufficient pressure, however, is retained by the G and D melody strings to maintain the foot 59 of the main bridge in secure contact with the belly of the instrument.

As can be seen, the counter pressure system serves to decrease the pressure on the main bridge whereupon the bridge may be fabricated from softer woods than those traditionally used for this purpose. The geometry of the main bridge may also be altered to reflect this decrease in strain. By making the main bridge out of the same wood as that used to form the belly of the sound box of the instrument, the amount of wear produced by the feet of the bridge is minimized or eliminated without sacrificing quality. In fact, because the softer wood is able to more freely vibrate, the tonal quality of the instrument will increase with usage. A noticeable increase in quality is also produced by shaping the thickness of the bridge in a lateral direction so that it increases uniformly from the first string side toward the opposite side. The thinness of the wood beneath the melody strings is believed to contribute to the impetus of the vibrations while more wood toward the foot end will keep the bridge from shattering the sounds that are generated. Accordingly, the thickness of the main bridge is also increased from the string contact edge 61 toward the foot end thereof. By this arrangement, it is possible to play or bow the strings close to the bridge without producing a whistling effect while, at the same time, retaining strength of tone some distance from the bridge.

In practice, the counter pressure strings are pulled as taut as possible to insure that the counter pressure bridge is securely suspended in place and to allow for proper tuning of the melody strings. To insure equal stretching of the strings in each run, it is preferred that pulleys 63 be mounted in the string openings 33—33 provided in the main tail piece of the instrument. A small, fine tuner 65, as known and used in the art, is attached to the E string near the floating tail piece 19. As best seen in FIG. 8, the fine tuner 65 is mounted upon an ebony mounting piece 68 having a hole 70 formed in the back portion thereof. A string 67 is passed through the hole 70 with one end of the string being secured to a stanchion 69 anchored in the main tailpiece 26 and the other end of the string being secured in the last receiving hole 66 provided at the forward margin of the floating tailpiece 19. When the melody strings are tuned, the higher forces exerted by the E string will be shared through this mounting arrangement between the two tailpieces thereby helping to more effectively balance the system. With the system tuned and balanced, a noticeable increase in volume and quality of tone is produced. Also, because of the manner in which the present system distributes the string vibrations, more wood can be put into the instrument thereby improving its resonance. Accordingly, the present system has the unique ability of providing what might be considered a mediocre instrument with a high quality response.

While this invention has been described with reference to the structure disclosed herein, it is not confined to the details set forth and this application is intended to cover any modifications or changes as may come within the scope of the following claims.

I claim:

1. A method of increasing the volume and tonal quality of a stringed instrument including the steps of providing a suspension system made up of at least one counter pressure string, suspending the said at least one counter pressure string beneath the melody strings of the instrument, interposing a counter pressure bridge between the melody strings and at least one counter pressure string whereby a portion of the pressure exerted by the melody strings upon the main bridge is transferred to the counter pressure string, and positioning an auxiliary bridge between the sound box of the instrument and the counter pressure string, with said auxiliary bridge spaced apart from said main bridge so as to contact said sound box at a different point from the main bridge, whereby the pressure transferred to the at least one counter pressure string is imparted to the sound box of the instrument through the auxiliary bridge.

2. The method of claim 1 that further includes the step of passing the counter pressure string back and forth between the finger board and the tailpiece of the instrument to provide a plurality of runs beneath the melody strings.

3. The method of claim 2 further including the step of extending the runs through at least one opening provided in the main bridge whereby the pressure carried by the runs is not imparted to the main bridge.

4. The method of claim 2 wherein the number of runs is equal to the number of melody strings.

5. The method of claim 1 further including mounting a sound post extending between the belly and the back of the sound box beneath both the main bridge and the auxiliary bridge of the instrument.

6. The method of claim 5 including the step of locating each sound post close to the foot of the overlying bridge that is on the first string side thereof.

7. The method of claim 1 further including the step of aligning the counter pressure bridge and the auxiliary bridge parallel with the main bridge at about an equal distance from said main bridge.

8. Apparatus for extending the volume and the tonal quality of a stringed instrument of the type having a finger board, a main tailpiece and a main bridge for supporting the melody strings above the belly of the sound box between the finger board and the main tailpiece, the apparatus including a floating tailpiece suspended between one end of the melody strings and the main tailpiece, a series of counter pressure strings that are passed through the main tailpiece and which are anchored at one end in the floating tailpiece and at the other end in the finger board to provide a suspension system that is supported beneath the melody strings, a counter pressure bridge interposed between the melody strings and counter pressure strings so that a portion of the melody string pressure is transferred to the counter pressure strings, and an auxiliary bridge mounted between the counter pressure strings and the belly of the sound box, with said auxiliary bridge spaced apart from said main bridge so as to contact said sound box at a different point from the main bridge, whereby the pressure exerted on said counter pressure strings is transferred to the sound box.

9. The apparatus of claim 8 wherein said main bridge contains at least one opening to permit the counter pressure string runs to pass in non-contiguous relation therethrough.

10. The apparatus of claim 8 which further includes a first sound post mounted between the belly and the back of the sound box beneath the main bridge and a second sound post similarly mounted beneath the auxiliary bridge.

11. The apparatus of claim 10 wherein each sound post is located on the first string side of the bridge.

12. The apparatus of claim 11 wherein the second sound post is positioned closer to the central axis of the sound box than the second sound post.

13. The apparatus of claim 8 wherein the top surface of both the counter pressure bridge and the auxiliary bridge slope laterally away from the first string in contact therewith on the first string side of the instrument.

14. The apparatus of claim 8 wherein the main bridge is constructed of the same wood as the belly of the sound box.

15. The apparatus of claim 10 wherein the first and the second sound post are cylindrical in form having a smaller diameter at the center than at the two extreme ends.

16. The apparatus of claim 8 further including a fine tuner connected at one end to the first string of the instrument and at the other end to a string that is secured between the main tailpiece and the floating tailpiece.

17. The apparatus of claim 8 that further includes a series of pulleys mounted in the main tailpiece over which the runs of the counter pressure string track.

18. The apparatus of claim 8 wherein said counter pressure bridge further includes a bifurcated base wherein the bifurcations extend laterally across the bridge to enable the bridge to be securely mounted upon the counter pressure string runs.

19. The apparatus of claim 18 wherein said counter pressure bridge contains a series of notches formed along its base for receiving the runs of the counter pressure strings therein and thus provide lateral spacing to said runs.

20. A stringed instrument having a plurality of melody strings supported above the belly of a sound box upon a main bridge including a string suspension system having a plurality of spaced-apart runs mounted beneath the melody strings of the instrument and being positioned along the belly of the sound box, a counter pressure bridge seated in biasing contact against both the melody strings and the suspension system runs with the top of said bridge in contact with the melody strings and the bottom of said bridge seated upon said runs, and an auxiliary bridge, with said auxiliary bridge spaced apart from said main bridge so as to contact said sound box at a different point from the main bridge, and having its top surface seated in contact against the suspension system runs.

21. The stringed instrument of claim 20 wherein the main bridge contains at least one opening to permit the suspension system runs to pass freely therethrough.

22. The stringed instrument of claim 21 wherein the main bridge is positioned about equi-distance between the counter pressure bridge and the auxiliary bridge.

23. The stringed instrument of claim 22 wherein the auxiliary bridge is positioned on the finger board side of the main bridge.

24. The stringed instrument of claim 23 that further includes a first sound post mounted in the sound box beneath the main bridge and a second sound post mounted in the sound box beneath the auxiliary bridge.

25. The stringed instrument of claim 24 wherein the two sound posts are situated on the first string side of the instrument.

26. The stringed instrument of claim 25 wherein the second sound post is closer to the central axis of the sound box than is the second sound post.

* * * * *